US007964044B1

(12) United States Patent
Block et al.

(10) Patent No.: US 7,964,044 B1
(45) Date of Patent: Jun. 21, 2011

(54) FERROUS METAL MAGNETITE COATING PROCESSES AND REAGENTS

(75) Inventors: William V. Block, Apple Valley, MN (US); Bryce D. Devine, St. Paul, MN (US)

(73) Assignee: Birchwood Laboratories, Inc., Eden Prairie, MN (US)

( * ) Notice: Subject to any disclaimer, the term of this patent is extended or adjusted under 35 U.S.C. 154(b) by 1036 days.

(21) Appl. No.: 10/978,087

(22) Filed: Oct. 28, 2004

Related U.S. Application Data

(60) Provisional application No. 60/515,901, filed on Oct. 29, 2003.

(51) Int. Cl.
*C23C 22/00* (2006.01)

(52) U.S. Cl. ..... 148/252; 427/309; 148/243

(58) Field of Classification Search ..... 148/252, 148/243, 272, 276; 427/309
See application file for complete search history.

(56) References Cited

U.S. PATENT DOCUMENTS

| | | | | |
|---|---|---|---|---|
| 2,148,331 | A | 2/1939 | Weisberg et al. | |
| 2,774,696 | A | 12/1956 | Gibson | |
| 2,791,525 | A | 5/1957 | Rausch et al. | |
| 2,805,969 | A | 9/1957 | Goodspeed et al. | |
| 2,817,610 | A * | 12/1957 | Newell et. al. | 148/271 |
| 2,835,616 | A | 5/1958 | Rausch et al. | |
| 2,850,417 | A | 9/1958 | Jenkins et al. | |
| 2,960,420 | A | 11/1960 | Mitchell | |
| 3,053,691 | A | 9/1962 | Hartman et al. | |
| 3,053,692 | A | 9/1962 | Pocock | |
| 3,083,149 | A | 3/1963 | Cranston | |
| 3,121,033 | A | 2/1964 | Stapleton | |
| 3,346,522 | A | 10/1967 | Schuster et al. | |
| 3,481,762 | A | 12/1969 | Streicher | |
| 3,559,280 | A | 2/1971 | Mailhiot et al. | |
| 3,598,659 | A | 8/1971 | Klingler et al. | |
| 3,632,452 | A | 1/1972 | Matsushima et al. | |
| 3,649,371 | A | 3/1972 | Tongyai | |
| 3,658,603 | A | 4/1972 | Boyer | |
| 3,677,827 | A | 7/1972 | Weaver et al. | |
| 3,706,604 | A | 12/1972 | Plaxton | |
| 3,709,742 | A | 1/1973 | Jacobs | |
| 3,753,942 | A | 8/1973 | Moran et al. | |
| 3,806,375 | A | 4/1974 | McLeod et al. | |
| 3,879,237 | A | 4/1975 | Faigen | |
| 3,899,367 | A * | 8/1975 | Mitchell | 148/271 |
| 3,929,514 | A | 12/1975 | Houlihan et al. | |
| 3,936,445 | A | 2/1976 | Pfitzner et al. | |
| 4,006,041 | A | 2/1977 | Fabregas et al. | |
| 4,017,335 | A | 4/1977 | Maloney | |
| 4,018,934 | A | 4/1977 | Parliment | |
| 4,086,182 | A | 4/1978 | Hengelhaupt et al. | |
| 4,140,551 | A | 2/1979 | Jones | |
| 4,199,624 | A * | 4/1980 | Smith | 427/309 |
| 4,246,030 | A | 1/1981 | Lipinski | |
| 4,296,182 | A | 10/1981 | Matsubayashi et al. | |
| 4,298,405 | A | 11/1981 | Saus et al. | |
| 4,565,585 | A | 1/1986 | Matsuda | |
| 4,591,397 | A | 5/1986 | Jones et al. | |
| 4,728,365 | A | 3/1988 | Jarvi | |
| 4,781,948 | A | 11/1988 | Caldwell | |
| 4,789,409 | A | 12/1988 | Jarvi | |
| 4,794,139 | A | 12/1988 | Braden et al. | |
| 4,806,161 | A | 2/1989 | Fabiny et al. | |
| 4,944,812 | A | 7/1990 | Lindert et al. | |
| 5,089,349 | A | 2/1992 | Kaiser | |
| 5,104,463 | A | 4/1992 | Menke | |
| RE34,272 | E | 6/1993 | Michaud et al. | |
| 5,320,872 | A | 6/1994 | McNeel et al. | |
| 5,466,297 | A | 11/1995 | Goodman et al. | |
| 5,580,063 | A | 12/1996 | Edwards | |
| 5,591,275 | A | 1/1997 | Miyafuji et al. | |
| 5,601,663 | A | 2/1997 | Rungta et al. | |
| 5,667,599 | A | 9/1997 | Rungta et al. | |
| 5,704,995 | A | 1/1998 | Bradley | |
| 5,723,183 | A | 3/1998 | Williams et al. | |
| 5,919,318 | A | 7/1999 | Brands et al. | |
| 6,171,409 | B1 | 1/2001 | Hamacher et al. | |
| 6,193,815 | B1 | 2/2001 | Wada et al. | |
| 6,277,214 | B1 | 8/2001 | Akhtar et al. | |
| 6,309,476 | B1 | 10/2001 | Ravenscroft et al. | |
| 6,527,873 | B2 | 3/2003 | Ravenscroft et al. | |
| 6,576,346 | B1 | 6/2003 | Ravenscroft et al. | |
| 2002/0069900 | A1 * | 6/2002 | Evers | 134/40 |
| 2002/0108678 | A1 * | 8/2002 | Montano et al. | 148/276 |
| 2003/0079807 | A1 | 5/2003 | Ravenscroft et al. | |

FOREIGN PATENT DOCUMENTS

| | | |
|---|---|---|
| DE | 2623604 | 12/1976 |
| DE | 4217098 | 11/1992 |
| EP | 0264471 | 4/1988 |

(Continued)

OTHER PUBLICATIONS

Birchwood Laboratories, Inc. "Safe, Low Cost, In-house Blackening with the Presto® Black Process," Birchwood Laboratories, Inc., Eden Prairie, MN; no. date (6 pages).

(Continued)

*Primary Examiner* — Roy King

*Assistant Examiner* — Jie Yang

(74) *Attorney, Agent, or Firm* — Pauly, DeVries Smith & Deffner, L.L.C.

(57) ABSTRACT

A process for forming a magnetite coating on a ferrous metal surface and for chemical reagents used to implement the coating process. The process comprises the step of making the ferrous metal surface more reactive by contacting the surface with an activating reagent and then contacting the activated surface with an oxidizing reagent to form the coating at a relatively low temperature range. The surface is activated by contact with an acid solution to form a surface rich in reactive iron. The activated surface is then oxidized by contact with an aqueous reagent of alkali metal hydroxide, alkali metal nitrate, alkali metal nitrite, and mixtures thereof.

12 Claims, No Drawings

FOREIGN PATENT DOCUMENTS

| | | | |
|---|---|---|---|
| EP | 0264472 | | 4/1988 |
| JP | 60-128288 | * | 7/1985 |
| JP | S62-186466 | | 7/1987 |
| JP | 01-073093 | * | 3/1989 |

OTHER PUBLICATIONS

Birchwood Casey, "Guide to Room Temperature Antiquing without Hazardous Effluent"; Birchwood Casey; Eden Prairie, MN (no date).

Birchwood Casey, In-House Blackening with No EPA Regulated Chemicals brochure: Birchwood Casey: Eden Prairie, MN (No Date).

Birchwood Casey, "Your Practical Guide and Cost Analysis"; Birchwood Casey; Eden Prairie, MN; Aug. 1997.

Cotton, F. Albert and Wilkinson, Geoffrey, "Advanced Inorganic Chemistry A comprehensive Text", Interscience Publishers, NY, pp. 847-863, (1962. no month).

Daniels, Christopher; "Black-Oxide Basics: Improved protection, appearance and performance with black oxide finishes", Products Finishing; Jul. 1992.

DU-LITE, "DULITE's® Guide to Hot Black Oxide Processes", The Du-Lite Corporation; Middletown CT; 1994 (no month).

Godding, A. D.; "The Basics of Black Oxide Finishing: Why to do it, how to do it, applications and advantages", Products Finishing; Feb. 1990.

Godding, A. D.; "Why Black Oxide? Here's how and why", Products Finishing; Apr. 1986.

Hubbard-Hall, "'Activated' Black Magic 'Plus': The cutting edge for quality and performance when hot black oxiding steel;" Hubbard-Hall; Waterbury, CT (no date).

Hubbard-Hall, "Activated Black Magic Plus" http://www.hubbard-hall.com/files/2232001.pdf; Hubbard-Hall, Waterbury, CT; 2003.

Ruhland, Mark; "Blackening of Ferrous Metals;" Birchwood Casey and PF Directory; Eden Prairie, MN, (1999; no month).

National Toxicology Program; "Thiourea—CAS No. 62-56-6: First listed in the Third Annual Report on Carcinogens"; Tenth Report on Carcinogens; date unknown.

Radian Corporation; "N,N'-Diethylthiourea", NTP Chemical Repository (Radian Corporation); Aug. 29, 1991.

Birchwood Casey, "Material Safety Data Sheet: Presto® Black Brush-On BST4 "; Birchwood Laboratories, Inc.; Eden Prairie, MN ; Apr. 2, 2001.

William V. Block, Thesis: Electroless Blackening of Ferrous Metals: Development of an Environmentally Friendlier Method, Kennedy-Western University, Apr. 2002, pp. 1-182.

* cited by examiner

FERROUS METAL MAGNETITE COATING PROCESSES AND REAGENTS

CROSS REFERENCE TO RELATED APPLICATION

This application claims the benefit of U.S. Provisional Application Ser. No. 60/515,901 filed Oct. 29, 2003.

FIELD OF TECHNOLOGY

The technology described in this specification relates to (a) processes for formation of a chemically bonded magnetite coating on the surface of reactive ferrous metal, (b) the composition of activating reagents and oxidizing reagents used in the processes of formation of the magnetite coating, and (c) the coated ferrous metal made by the processes.

DESCRIPTION OF EMBODIMENTS

The processes of the embodiments described in this specification produce a high quality, chemically bonded magnetite coating on ferrous metal. The coating imparts an adherent, black finish. The finish serves as a final, high quality protective coating on a fabricated ferrous metal product and also affords a degree of lubricity to aid assembly, facilitate break-in of sliding surfaces, and provide anti-galling protection. The coating provides an adherent base for paint finishes.

The processes are operated in a temperature range that is relatively low compared to extant ferrous metal coating processes. The processes are conducted using activating reagents and oxidizing reagents. The activating reagents are comprised of aqueous solutions of acids. The oxidizing reagents are comprised of aqueous solutions of oxidizing agents. The concentrations of the activating reagents and oxidizing reagents are also relatively low compared to extant ferrous metal coating processes. The relatively low temperature of the activating reagents and oxidizing reagents and the relatively low concentrations of the activating reagents and oxidizing reagents results in increased operator safety, lower environmental impact, lower energy usage, and lower activating reagent and oxidizing reagent cost. Furthermore, the embodiments of the processes are uncomplicated to operate.

The embodiments described in this specification produce magnetite coatings without use of the highly caustic oxidizing reagents used in extant blackening processes. They furthermore, do not require that an intermediate conversion coating be formed on the ferrous metal substrate prior to formation of the magnetite finish coating.

The process comprises making the surface of the ferrous metal substrate more active by contacting the surface with an acid, the activating reagent, and then by direct oxidation of the surface, with the oxidizing reagent, to magnetite at a temperature in the range of about 70° F. to about 220° F.

In this specification, ferrous metal is used in its broadest sense as would be understood by one of ordinary skill in the field of metallurgy. Without limiting the generality of the foregoing, ferrous metal includes, but is not limited to, iron (such as cast iron and wrought iron), ferrous alloys, and steel (such as carbon steels, alloy steels, and stainless steels).

The ferrous metal substrates on which the embodiments (a) of the processes for formation of a chemically bonded magnetite coating on ferrous metal and (b) of the compositions of the activating reagents and the oxidizing reagents, described in this specification, are effective include, but are not limited to, the following ferrous metal substrates:

- Wrought carbon steels cleaned by abrasive methods, such as sanding, abrasive buffing, grit blasting, shot peening, vapor honing, vibratory finishing, and vibratory deburring. These techniques are used to remove scale and oxide from the metal surface.
- Wrought carbon steels polished or chemically cleaned (rather than abrasively cleaned) and which can be chemically treated more than once.
- Cast or ductile irons.
- Sintered steels (powder metal).

The cast, ductile, or sintered irons are inherently more reactive than most of the wrought ferrous metals. However, certain surface conditioning practices produce extremely reactive surfaces on otherwise low reactive ferrous metals. For example, some heat-treated steels, abrasively cleaned by shot blasting become highly reactive.

As in most chemical reactions, the activity level of the key reactants has a direct effect on the reaction rate and the degree to which the reaction is completed. The ferrous metal substrate is one of the key reactants of the embodiments described in this specification. And, highly reactive ferrous metal substrates blacken relatively quickly and easily. However, some ferrous metal substrates are so highly reactive that they accelerate the reaction rate to an uncontrollably excessive level. The magnetite finish produced in these cases is usually black, sooty, easily rubbed off, poorly adhered to the ferrous metal surface, not aesthetically pleasing, and unpleasant to handle.

Embodiments of highly reactive ferrous metal substrates that are amenable to the processes described in this specification include: steel surfaces cleaned with mechanical or abrasive blasting techniques, such as shot blasting, grit blasting, and shot peening; cast or ductile irons; and sintered metals. These abrasive cleaning methods remove scale, rust, and other surface contaminants. They also produce a ferrous metal substrate with significantly increased surface texture, which translates to increased surface area. And, they frequently leave a slight residue of surface-adherent insoluble substances and metallic fines. The increased surface area and the residue raise the innate level of reactivity of the surface by providing additional nucleation sites on the surface. The nucleation sites promote subsequent chemical reaction, including the formation of a magnetite finish. These highly reactive ferrous metal substrates are effectively black coated with an embodiment of the process at a temperature as low as about 70° F., without an intermediate iron and oxygen enriched conversion coating. The ability to blacken the substrate without the necessity of a conversion coating, results in costs savings, including those due to a reduction in tank scale and sludge when using the immersion method for contacting the substrate with the reagents.

Additionally, it has been found that even some of the less reactive ferrous metal substrates (such as tool steels and other ferrous metal substrates that have been cleaned by non-abrasive methods) can be blackened with repeated contacts with the process reagents. Some of these substrates include steel components with machined or ground surfaces. Even surfaces, which have not been abrasively cleaned may blacken directly, after repeated contacts with acid activation and blackening reagents.

Embodiments of processes described in this specification entail contacting a ferrous metal substrate with an initial activating reagent followed by contacting the ferrous metal substrate with an oxidizing reagent. The steps of contacting the ferrous metal substrate may be performed by immersing, wiping, spraying, and fogging the substrate with the reagents.

Magnetite coating formation is dependent on the type of ferrous metal being coated, the process parameters, and the composition of the acid activating reagent and the oxidizing reagent. Different embodiments of the processes and reagents have different process parameters, including ranges of temperature, constituents, and concentrations of the activating and oxidizing reagents. These process parameters differ depending upon the level of reactivity of the ferrous metal substrate. In one embodiment, if the surface of the ferrous metal substrate is relatively non reactive, smooth, and relatively hard or an alloy containing relatively low levels of iron (i.e., high levels of other alloying elements, such as nickel, chromium, and molybdenum), the process parameters are optimized to raise the activity level of the ferrous metal substrate and raise the reaction rate, thereby increasing the formation of magnetite. These modifications include one or more of the following steps: (a) modifying the reagents' composition; (b) increasing the reagents' concentration; (c) increasing the reagents' temperature; and (d) increasing the duration of the ferrous metal substrate's contact time with the reagents to the extent necessary to offset the low reactivity of the ferrous metal substrate. Conversely, for ferrous metal substrates that are innately more reactive, the process parameters are modified to accomplish the following: (a) decrease the activity level of the ferrous metal substrate; (b) slow the reaction rate; (c) avoid formation of a sooty or easily rubbed off magnetite coating; and (d) form a finer grain magnetite coating. These modifications include one or more of the following steps: (a) modifying the reagents' composition; (b) lowering the reagents' concentration; (c) lowering the reagents' temperature, and (d) decreasing the duration of the ferrous metal substrate's contact time with the reagents.

Different embodiments of the process produce magnetite coatings with differing characteristics, such as thickness, color, color hue, adherence, lubricity, aesthetic appearance, rust prevention, and porosity. Other embodiments may be optimized to produce magnetite coatings for differing ferrous metal substrates, such as iron (including cast iron and wrought iron), ferrous alloys, and steel (including carbon steels, alloy steels, and stainless steels). Other embodiments also comprise process steps other than those of activation and oxidation. Embodiments may also be optimized to produce magnetite coatings that differ depending upon the purpose of the coating, such as lubricity, aesthetics, or rust prevention. Generally, it is a goal to produce a coating that does not rub-off easily. That may, however, not be a goal when the purpose of the coating is to provide break-in lubricity or to aid part assembly. Likewise, it is usually a goal to produce a coating that is not sooty. But, for some applications a certain amount of soot is acceptable and may be useful.

An embodiment of the process of forming an ultra-thin, attractive, chemically bonded magnetite finish coating on ferrous metal, comprises the steps of:

- removing oils, oxides, and other soils from the ferrous metal surface by, for example, degreasing and descaling with chemical or abrasive substances;
- rinsing the ferrous metal substrate with water;
- chemically activating the ferrous metal substrate by, for example, contacting the ferrous metal substrate with an acid or pickling the substrate;
- rinsing the ferrous metal substrate with water;
- oxidizing the ferrous metal substrate for a period of time necessary to form a magnetite coating on the substrate;
- rinsing the ferrous metal substrate with water; and
- sealing the magnetite coated ferrous metal substrate with a rust preventive topcoat.

The process steps of chemical activation, rinsing, and oxidation can be repeated to vary the magnetite finish characteristics.

To offset formation of brown coatings, the use of a bath conditioner such as trisodium phosphate ($Na_3PO_4$) is effective. A sulfonate-based surface tension reducing agent may also be used to promote uniform surface activation, blackening, and rinsing.

An embodiment of the oxidizing reagent comprises no less than about the following:

| | |
|---|---|
| Sodium hydroxide (NaOH) | About 50 grams per liter |
| Sodium nitrate ($NaNO_3$) | About 16 grams per liter |
| Sodium nitrite ($NaNO_2$) | About 2 grams per liter |
| Stannous chloride ($SnCl_2$) | About 0.3 gram per liter |
| Sodium thiosulfate ($Na_2S_2O_3$) | About 2 grams per liter |
| Potassium thiocyanate (KSCN) | About 0.5 gram per liter |
| Sodium molybdate ($Na_2MoO_4$) | About 2 grams per liter |
| Petro AA | About 0.1 grams per liter |

The oxidizing reagents may be supplied in a granular or in a liquid concentrate. The granular form of the oxidizing reagent in one embodiment is in a concentration of about 1 to about 2 pounds per gallon of water.

Cleaning and rinsing of the ferrous metal substrate generally results in a more uniform and a more adherent magnetite coating. Abrasive removal of inorganic compounds, such as scale and rust (oxides), from the ferrous metal substrate are less likely to cause the formation of a sooty magnetite coating than is cleaning by acid pickling. It is not uncommon to follow abrasive cleaning of a ferrous metal substrate with a heated alkaline soak cleaning to remove embedded metal and soil particulates. The heated alkaline soak cleaning improves the quality of the magnetite finished ferrous metal substrate. Alkaline cleaners are effective for removal of a multitude of soils, such as oil, grease, and particulates. They are commercially available from a number of suppliers. And, they cause fewer environmental and health hazards than solvent cleaners.

Oxide traces on the surface of the ferrous metal substrate may interfere with formation of a magnetite coating at the lower process temperatures of embodiments described in this specification. Acid activation removes these oxides. The acid activating reagent raises the overall activity level of the ferrous metal substrate. The more oxide-free a ferrous metal surface is, the more easily the surface can be oxidized to magnetite. The surface becomes more reactive with the oxidizing reagent described in this specification. Stated in another manner, removal of oxides from the surface activates the metal surface. The metal surface is then more receptive to the oxidizing reagent at the relatively low temperature range and concentration described in this specification.

The activating acid may be any organic or inorganic water-soluble acid in which a sufficient amount of the acid can be dissolved to achieve an acidic pH. In one embodiment the pH is about 4.0 or less. Organic activating acids are comprised of those selected from: oxalic, citric, maleic, malonic, tartaric, formic, acetic, lactic, phytic, glycolic, cysteine, and cystine. Inorganic activating acids and acid salts are comprised of: hydrochloric, phosphoric, sulfuric, aluminum chloride, boron trifluoride, stannous chloride, stannic chloride, phosphonic acid, derivatives of phosphonic acid, sodium acid bisulfate, and sulfamic. A liquid acid such as phosphoric acid is easier to handle and costs less than organic acids or dry acid salts. Phosphoric acid is also relatively safer to handle than other mineral acids such as nitric, hydrochloric, and sulfuric acid. Embodiments of activating reagents are in the concentration ranges of: (a) organic acids, about 0.5 to about 100 grams per liter; (b) inorganic acids, about 2 to about 50% by weight; and (c) dry acids, about 20 to about 200 grams per liter.

An embodiment of the activating reagent also comprises a sequestrant to enhance the performance of the acid and to control scale and sludge build-up in the process tanks. Suitable sequestrants comprise (a) organophosphonic acids, such as aminotri-(methylene-phosphonic) acid (commercially available as Dequest 2000, Solutia Corp.), 1-hydroxyethylene-1-diphosphonic acid (Dequest 2010), and alkali metal salts thereof and (b) hydroxycarboxylic acids, such as citric acid, tartaric acid, gluconic acid, and alkali metal salts thereof. Another embodiment of the activating reagent also comprises an anionic surface tension reducer to promote uniform metal surface activation and rinsing. Anionic surface tension reducers, such as sulfonic acids and alkali metal salts of sulfonic acids, are stable in low (acid) as well as high (alkaline) pH environments. Suitable sulfonic acids and alkali metal salts of sulfonic acids comprise dodecyl benzene sulfonic acid or alkyl naphthalene sulfonate (commercially available as NAXAN® AAL or AAP from Ruetgers-Nease or Petro AA, commercially available from Witco Corp.).

Embodiments of the process and reagents described in this specification yield adherent black magnetite coatings at temperatures ranging from about 70 to about 220° F. with immersion in the oxidizing reagent for about 3 minutes to about one hour. An embodiment of the process of coating the ferrous metal substrate with magnetite comprises a step of immersing the ferrous metal substrate in the aqueous oxidizing reagent at a temperature in the range of about 70 to about 140° F. for a period of time in the range of about 0.5 to about 10 minutes.

Embodiments of Process

Six examples of embodiments for black coating grit blasted steel forgings, hardened and polished gun barrel steel, and A2 tool steel are presented in this section of the specification. Each of the embodiments of the processes are comprised of the steps of acid pickling activation followed by oxidation.

1. Forged Carbon Steel Wrench

A forged carbon steel wrench is abrasive blasted to remove surface scale and rust. Following blasting, the forged carbon steel wrench is cleaned in an alkaline soak to remove surface soils. The wrench is then cleaned in water.

The forged carbon steel wrench is immersed for about 2 to about 5 minutes at room temperature in an activating reagent comprised of about 120 grams per liter of sulfamic acid. The wrench is then rinsed in water.

The forged carbon steel wrench is immersed for about 10 minutes at about 200° F. in an oxidizing reagent comprised of:

| | |
|---|---|
| NaOH | About 130 g/L |
| $NaNO_3$ | About 45 g/L |
| $NaNO_2$ | About 6.5 g/L |
| $Na_2MoO_4$ | About 6.5 g/L |
| $Na_2S_2O_3$ | About 6.5 g/L |
| $SnCl_2$ | About 1.3 g/L |
| KSCN | About 2.5 g/L |
| Petro AA | About 0.1 g/L |

While immersed in the oxidizing reagent, the forged carbon steel wrench gradually takes on a deep black color.

The wrench is rinsed in water and sealed with a water displacing sealant.

2. Highly Polished Carbon Steel Gun Barrel

A highly polished carbon steel gun barrel, which is not abrasive blasted is cleaned in an alkaline soak to remove surface soils. The barrel is then cleaned in water.

The gun barrel is immersed for about 2 minutes at room temperature in an activating reagent comprising about 120 grams per liter of "Vortecid Zip™" inhibited dry acid salt.

After rinsing in water, the gun barrel was immersed for about 10 minutes at about 200° F. in an oxidizing reagent comprising:

| | |
|---|---|
| NaOH | About 130 g/L |
| $NaNO_3$ | About 45 g/L |
| $NaNO_2$ | About 6.5 g/L |
| $Na_2MoO_4$ | About 6.5 g/L |
| $Na_2S_2O_3$ | About 6.5 g/L |
| NAXAN ® AAL | About 0.1 g/L |
| $SnCl_2$ | About 1.3 g/L |
| KSCN | About 2.5 g/L |
| Ethylene thiourea | About 0.1 g/L |

While immersed in the oxidizing reagent, the gun barrel gradually acquires a dark gray color.

The activating and oxidizing steps are repeated, with rinsing between the steps, until a blacker color is achieved. Each subsequent repetition of the activating and oxidizing steps produces a darker shaded coating. The result is a decorative black coating that retains the gloss of the polished surface and has minimal rub-off.

3. Forged Steel Tie-Rod End

A forged steel tie-rod end is abrasive blasted to remove surface scale and rust. The tie-rod end is then cleaned in an alkaline soak to remove surface soils.

After rinsing in water, the tie-rod end is immersed at room temperature for about 2 to about 5 minutes in an activating reagent comprising about 4% by weight of phosphoric acid, about 1.0 gram per liter of Dequest 2010, about 1.0 gram per liter of citric acid, and about 1.0 gram per liter of dodecyl benzene sulfonic acid.

After rinsing in water, the tie-rod end is immersed for about 30 minutes at about 120° F. in oxidizing reagent comprising:

| | |
|---|---|
| NaOH | About 50 g/L |
| $NaNO_3$ | About 16 g/L |
| $NaNO_2$ | About 2 g/L |
| $SnCl_2$ | About 0.2 g/L |
| $NaS_2O_3$ | About 2 g/L |
| KSCN | About 0.5 g/L |
| $Na_2MoO_4$ | About 2 g/L |
| NAXAN ® AAL | About 0.1 g/L |

The tie-rod end acquires a deep black color during immersion.

The tie-rod end is then rinsed in water and sealed in an appropriate rust preventive topcoat. No coating rub-off is observed when the tie-rod end is wiped with a white paper towel.

4. Forged Steel Tie-Rod End

A forged steel tie-rod end is abrasive blasted to remove surface scale and rust. Following blasting, the forged steel tie-rod end is cleaned in an alkaline soak to remove surface soils.

After rinsing in water, the tie-rod end is immersed at room temperature for about 5 minutes in an activating reagent comprising about 5 grams per liter of oxalic acid and about 0.1 grams per liter of NAXAN® AAL.

After rinsing in clean water, the tie-rod end is immersed for about 15 minutes at about 180° F. in the oxidizing reagent of embodiment 3. The tie-rod end acquires a deep black color during immersion.

The tie-rod end is then rinsed in water and sealed in an appropriate rust preventive topcoat. No coating rub-off is observed when the tie-rod end is wiped with a clean white paper towel.

5. Forged Steel Wrench

A forged steel wrench is abrasive blasted to remove surface scale and rust. Following blasting, the forged steel wrench is cleaned in an alkaline soak to remove surface soils.

After rinsing in water, the forged steel wrench is immersed at room temperature for about 2 to about 3 minutes in an activating reagent comprising about 5% by weight of amino-tri(methylene)phosphonic acid (sold under the trade name Dequest™ 2000, manufactured by Solutia Inc., St. Louis, Mo.).

After rinsing in water, the forged steel wrench is immersed for about 20 minutes at about 160° F. in the oxidizing reagent of embodiment 2. The forged steel wrench acquires a deep black color during immersion.

The forged steel wrench is then rinsed in water and sealed in an appropriate rust preventive topcoat. No coating rub-off is observed when the forged steel wrench is wiped with a white paper towel.

6. Forged Tie Rod End

A forged tie rod end is abrasive blasted to remove surface scale and rust. Following blasting, the forged steel wrench is cleaned in an alkaline soak to remove surface soils.

After rinsing in water, the forged tie rod end is immersed in the activating reagent of embodiment 9, at room temperature, for a period of about 3 minutes.

After a water rinse, the forged tie rod end is immersed for about 1-hour at about 70° F. in an oxidizing reagent comprised of the following:

| | |
|---|---|
| NaOH | About 200 g/L |
| $NaNO_3$ | About 70 g/L |
| $NaNO_2$ | About 10 g/L |
| $SnCl_2$ | About 0.4 g/L |
| $Na_2S_2O_3$ | About 10 g/L |
| $Na_2MoO_4$ | About 10 g/L |
| KSCN | About 2 g/L |

The forged tie rod end acquires a dark gray-black color during immersion and exhibits no rub-off when immersed in rust preventive oil and wiped with a white paper towel.

Embodiments of the Activation Reagent Step of the Process

A. The activation step of the process includes, but is not limited to, the following embodiments of contacting the ferrous metal substrate with an activating reagent:

1. Contacting the ferrous metal substrate with an activating solution with a pH less than about 4.0, at a temperature of about 70 to about 140° F., for about 1 to about 10 minutes.

2. Contacting the ferrous metal substrate with an activating reagent comprising sodium acid bisulfate at a concentration of about 100 to about 200 grams per liter, a contact time of about 1 to about 10 minutes, and at a temperature at about 70 to about 140° F.

3. Contacting the ferrous metal substrate with an activating reagent comprising sodium acid bisulfate at a concentration of about 20 to about 200 grams per liter, a contact time of about 2 to about 5 minutes, and at a temperature at about 70 to about 140° F.

4. Contacting the ferrous metal substrate with an activating reagent comprising sodium acid bisulfate at a concentration of about 20 to about 200 grams per liter, a contact time of about 1 to about 10 minutes, and at a temperature at about 70 to about 80° F.

5. Contacting the ferrous metal substrate with an activating reagent comprising sodium acid bisulfate at a concentration of about 100 to about 200 grams per liter, a contact time of about 2 to about 5 minutes, and at a temperature at about 70 to about 140° F.

6. Contacting the ferrous metal substrate with an activating reagent comprising sodium acid bisulfate at a concentration of about 100 to about 200 grams per liter, a contact time of about 2 to about 5 minutes, and at a temperature at about 70 to about 80° F.

7. Contacting the ferrous metal substrate with an activating reagent comprising sodium acid bisulfate at a concentration of about 100 to about 200 grams per liter, a contact time of about 2 to about 5 minutes, and at a temperature at about 70 to about 80° F.

8. Contacting the ferrous metal substrate with an activating reagent comprising sodium acid bisulfate at a concentration of about 20 to about 200 grams per liter, a contact time of about 2 to about 5 minutes, and at a temperature at about 70 to about 80° F.

Vortecid Zip™ (Metalline Chemical Co., Mequon, Wis.) is a commercially available product that is an embodiment of the activation reagent. Other embodiments are described elsewhere in this specification.

B. The activation step of the process further includes, but is not limited to, the following 7 embodiments of contacting the ferrous metal substrate with an activating reagent:

1. Contacting the ferrous metal substrate with an activating reagent comprising sulfamic acid at a concentration of about 20 to about 200 grams per liter and a temperature range from about 70 to about 150° F.

2. Contacting the ferrous metal substrate with an activating reagent comprising sulfamic acid at a concentration of about 100 to about 200 grams per liter and a temperature of about 70 to about 150° F.

3. Contacting the ferrous metal substrate with an activating reagent comprising sulfamic acid at a concentration of about 20 to about 200 grams per liter and at room temperature.

4. Contacting the ferrous metal substrate with an activating reagent comprising sulfamic acid at a concentration of about 100 to about 200 grams per liter and at room temperature.

5. Optionally, the sulfamic acid activating reagent of the 4 preceding embodiments may also comprise a fluoride salt (i.e., NaF, $NaF_2$, $NH_4F_2$) at a concentration of about 1 to about 10 grams per liter.

6. Optionally, the sulfamic acid activating reagent of the 5 preceding embodiments may also comprise a wetting agent such as alkyl naphthalene sodium sulfonate (NAXAN AAP, Ruetgers-Nease Corp.; or Petro AA, Witco Corp.) at a concentration of about 1 to about 2 grams per liter.

7. Optionally, the sulfamic acid activating reagent of the 6 preceding embodiments may also comprise an inhibitor (Armohib 31, Akzo-Nobel Chemical Co.) at a concentration of about 0.1 to about 1.0 grams per liter.

C. The activation step of the process further includes, but is not limited to, the following embodiments of contacting the ferrous metal substrate with an activating reagent:

1. Contacting the ferrous metal substrate with an activating reagent comprising phosphoric acid at a concentration of about 2 to about 20% by weight, for about 1 to about 10 minutes, and at a temperature of about 70 to about 140° F.

2. Contacting the ferrous metal substrate with an activating reagent comprising phosphoric acid at a concentration of about 5 to about 10% by weight, for about 1 to about 10 minutes, and at a temperature of about 70 to about 140° F.

3. Contacting the ferrous metal substrate with an activating reagent comprising phosphoric acid at a concentration of about 5 to about 10% by weight, for about 2 to about 5 minutes, and at a temperature of about 70 to about 140° F.

4. Contacting the ferrous metal substrate with an activating reagent comprising phosphoric acid at a concentration of about 5 to about 10% by weight, for about 2 to about 5 minutes, and at a temperature of about 70 to about 80° F.

5. Optionally, the phosphoric acid activating reagent of the 4 preceding embodiments may also comprise Dequest 2010 at a concentration of about 1.0% by volume.

6. Optionally, the phosphoric acid activating reagent of the preceding 5 embodiments may also comprise citric acid at a concentration of about 1.0% by weight.

Embodiments of the Oxidizing Reagent

The oxidation reagent composition includes, but is not limited to, the following embodiments:

1. Oxidation reagents disclosed in U.S. Pat. No. 6,309,476.

2. Oxidizing reagent, comprising:

| | |
|---|---|
| Sodium hydroxide | About 50 to about 200 g/L |
| Sodium nitrate | About 15 to about 75 g/L |
| Sodium nitrite | About 2 to about 10 g/L |
| Stannous chloride | About 0.2 to about 2 g/L |
| Sodium thiosulfate | About 2 to 10 about g/L |
| Potassium thiocyanate | About 0.5 to about 3 g/L |
| Sodium molybdate | About 2 to about 10 g/L |

3. The oxidizing reagent of any of embodiments 1 and 2, also comprising a surface tension reducing agent, such as naphthalene sodium sulfonates (manufactured by the Witco Corporation under the trademark Petro AA and by Ruetgers-Nease Corporation under the trademark NAXAN AAP). The surface tension reducing agent promotes uniform surface activation and rinsability and reduces drag-out from the oxidizing reagent.

4. The oxidizing reagent of any of embodiments 1-3, also comprising a thio-based accelerator.

5. The oxidizing reagent of any of embodiments 1-4, wherein the temperature of the oxidizing reagent is in the range of about 180° F. to about 210° F.

6. The oxidizing reagent of any of embodiments 1-5, wherein the oxidizing reagent is comprised of not less than the following:

| | |
|---|---|
| Sodium hydroxide | About 50 grams per liter |
| Sodium nitrate | About 16 grams per liter |
| Sodium nitrite | About 2 grams per liter |
| Stannous chloride | About 0.3 gram per liter |
| Sodium thiosulfate | About 2 grams per liter |
| Potassium thiocyanate | About 0.5 gram per liter |
| Sodium molybdate | About 2 grams per liter |
| Napthalene sodium sulfonate | About 0.1 grams per liter |

This specification discloses embodiments of a process of forming a chemically bonded magnetite coating on ferrous metal substrates, the composition of activating reagents used in the process, and the composition of oxidizing reagents used in the process. One skilled in the art will appreciate that the invention can be practiced by other than the described embodiments, which are presented for purposes of illustration and not limitation.

We claim:

1. A process for forming a magnetite coating on ferrous metal substrates, the process comprising:

removing oxides from the surface of the ferrous metal substrate without formation of an intermediate conversion coating by contacting the substrate with an aqueous acidic solution comprising sulfamic acid and alkyl naphthalene sodium sulfonate; and forming a magnetite coating on the surface of the ferrous metal substrate after removing the oxides and without forming an intermediate conversion coating by contacting the surface of the ferrous metal substrate with an aqueous oxidizing solution, the ferrous metal substrate lacking an intermediate conversion coating, to directly oxidize iron on the surface of the ferrous metal substrate to form a magnetite coating, the aqueous oxidizing solution comprising from about 0.2 g/L to about 2 g/L of $SnCl_2$.

2. The process of claim 1, the aqueous acidic solution at a temperature of about 70 to about 140 degrees Fahrenheit.

3. The process of claim 1, the aqueous oxidizing solution comprising from about 0.5 g/L to about 3 g/L of KSCN.

4. The process of claim 1, the aqueous oxidizing solution comprising about 2.5 g/L of KSCN.

5. The process of claim 1, the aqueous oxidizing solution comprising about 1.3 g/L of $SnCl_2$.

6. The process of claim 1, the aqueous oxidizing solution at a temperature of about 180 to about 210 degrees Fahrenheit.

7. A process for forming a magnetite coating on ferrous metal substrates, the process comprising:

removing oxide traces from the surface of a ferrous metal substrate through contact with an aqueous acidic solution comprising sulfamic acid and alkyl naphthalene sodium sulfonate;

removing the residual aqueous acidic solution from the ferrous metal substrate; and forming a magnetite coating on the surface of the ferrous metal substrate without forming an intermediate conversion coating by contacting the activated metal substrate lacking an intermediate conversion coating with an aqueous oxidizing solution, the aqueous oxidizing solution comprising from about 0.2 g/L to about 2 g/L of $SnCl_2$.

8. The process of claim 7, the aqueous acidic solution at a temperature of about 70 to about 140 degrees Fahrenheit.

9. The process of claim 7, the aqueous oxidizing solution comprising from about 0.5 g/L to about 3 g/L of KSCN.

10. The process of claim 7, the aqueous oxidizing solution comprising about 2.5 g/L of KSCN.

11. The process of claim 7, the aqueous oxidizing solution comprising about 1.3 g/L of $SnCl_2$.

12. The process of claim 7, the aqueous oxidizing solution at a temperature of about 180 to about 210 degrees Fahrenheit.

* * * * *